US006685287B1

(12) United States Patent
Teel

(10) Patent No.: US 6,685,287 B1
(45) Date of Patent: Feb. 3, 2004

(54) COMBINATION CORNER HUTCH AND DINING TABLE

(76) Inventor: Embry Alden Teel, 4050 Stilesboro Rd., Kennesaw, GA (US) 30152

( * ) Notice: Subject to any disclaimer, the term of this patent is extended or adjusted under 35 U.S.C. 154(b) by 0 days.

(21) Appl. No.: 10/313,226

(22) Filed: Dec. 6, 2002

(51) Int. Cl.[7] ..... A47B 81/00
(52) U.S. Cl. ..... 312/238
(58) Field of Search ..... 312/238, 239, 312/257.1, 280, 281, 351, 237; D6/329, 336

(56) References Cited

U.S. PATENT DOCUMENTS

| | | | | | |
|---|---|---|---|---|---|
| 878,769 | A | | 2/1908 | Campbell | |
| 880,185 | A | | 2/1908 | Beverly | |
| 1,597,834 | A | * | 8/1926 | Scudder | 312/238 X |
| 1,700,545 | A | | 1/1929 | Sanders | |
| 1,778,163 | A | | 10/1930 | Moore | |
| 1,949,404 | A | | 3/1934 | Bailey | |
| 2,368,285 | A | * | 1/1945 | Bullard | 312/238 |
| D140,702 | S | | 3/1945 | Twente | |
| 2,566,256 | A | | 8/1951 | Snyder | |
| 3,297,382 | A | | 1/1967 | Snowden | |
| 3,592,520 | A | | 7/1971 | Marino | |
| 3,745,936 | A | | 7/1973 | Bennett | |
| 3,936,110 | A | | 2/1976 | Meggs | |
| D250,237 | S | | 11/1978 | Hero | |
| D364,756 | S | | 12/1995 | Felber | |
| 5,513,574 | A | | 5/1996 | Collins | |
| 5,601,348 | A | | 2/1997 | Minkovski | |
| 5,628,255 | A | * | 5/1997 | Neuner | 108/42 |
| D430,763 | S | | 9/2000 | Scheffer | |
| 6,283,564 | B1 | * | 9/2001 | Corson | 312/223.2 |

FOREIGN PATENT DOCUMENTS

| | | | | |
|---|---|---|---|---|
| GB | 9326 | * | of 1897 | 312/238 |
| GB | 353312 | * | 7/1931 | 312/238 |

OTHER PUBLICATIONS

Corner Hutch & Buffet Furniture Plan, "Corner Hutch Base" and "Corner Hutch Top", Jun. 2001, 2 pages.*

* cited by examiner

*Primary Examiner*—James O. Hansen

(57) ABSTRACT

A novel economically constructed freestanding combination corner hutch and dining table physically and structurally configured to accommodate placement into a typical room corner in order to economize space and simultaneously provide a uniquely designed, attractive, ergonomic, efficient, beneficial and desirable article of furniture.

1 Claim, 4 Drawing Sheets

COMBINATION CORNER HUTCH AND DINING TABLE

CROSS-REFERENCES TO RELATED APPLICATIONS

The above inventor simultaneously filed a design patent application for this same entitled invention.

STATEMENT REGARDING FEDERALLY SPONSORED RESEARCH OR DEVELOPMENT

Not applicable.

REFERENCE TO A "SEQUENCE LISTING", A TABLE, OR A COMPUTER PROGRAM LISTING APPENDIX SUBMITTED ON A COMPACT DISC

Not applicable.

BACKGROUND OF THE INVENTION

The present invention relates to a freestanding combination corner hutch and dining table triangularly configured to accommodate placement into a typical room corner.

Numerous articles of "combination type" furniture have been designed to serve multi-functional purposes and have long been constructed by furniture manufacturers in the past as well as in the present. An example of such an article would be a combination table and shelving unit such as a hutch or cabinet that combined or constructed together would occupy significantly less space than that of the individual furniture components. Both the space savings and the consequent reductions in construction material and labor obviously provide economical benefits to consumers and manufacturers alike. In addition to the economical advantages, such combination type pieces of furniture also offer uniqueness, attractiveness, decor, style, comfort, display, storage, ergonomics, efficiency and therefore desirability and consumer demand.

Many different designs of this combination type of furniture exist in the form of eating/dining tables, nooks, work tables, desks, recreation tables and the like constructively combined with open or closed shelving structures such as hutches, breakfronts, closets, cabinets, secretaries, armoires and the like. These different designs are equally used in both the home as well as in the work place. Combination type furniture design is not limited in use or placement in a specific location, room or office in either a home or in a work place. Neither are these articles of furniture limited in their structural support as some are attached to wall structures or the like, and others are designed as freestanding units.

It is well known that the corners of dining rooms, kitchens and the like found in a typical home are generally not utilized well. In regards to the present invention many utility and design patents have been granted for combination table and shelving articles of furniture that were designed to be positioned against a wall or in the corner of such rooms.

For example U.S. Pat. No. 1,949,404 reflects a freestanding combination closet, seat and table design. U.S. Pat. No. 1,778,163 depicts a freestanding kitchen cabinet complete with table, cabinet shelves, and drawers. U.S. Pat. No. 3,592,520 is a freestanding combined breakfront with shelving and dining table. U.S. Pat. No. 878,769 is also an example of a freestanding kitchen-cabinet table. U.S. Pat. Nos. 880,185, D140, 702 and 3,745,936 also reflect freestanding cabinets with tables and shelving. All of the aforementioned patents are freestanding articles of combination furniture but they are not physically configured for placement in the corner of a room and their tables are not stationary as they fold, pivot or move in some way or offer table storage.

U.S. Pat. No. D250,237 is a large freestanding combined table, shelf and cabinet unit. U.S. Pat. No. 5,601,348 is also a large freestanding combination table and shelving article of furniture. U.S. Pat. No. 3,297,382 is another large freestanding combination cabinet and table. All three of these patents are physically configured for placement in the corner of a room but are designed for use as multi-use extensive wall units and not strictly as a corner unit as is an object of the present invention.

Both U.S. Pat. Nos. D430,763 and 5,628,255 are freestanding corner combination tables and shelving but are designed as desk type furniture.

U.S. Pat. Nos. D364,756; 1,700,545; 2,566,256; 3,936,110 and 5,513,574 are still other examples of combination tables and shelving units but are not physically configured for placement in the corner of a room.

It is an object of the present invention to provide a novel economically constructed freestanding combination corner hutch and dining table that is stationary and constructed as a unitary article of furniture.

BRIEF SUMMARY OF THE INVENTION

It is an object of the present invention to provide a novel economically constructed freestanding combination corner shelved hutch and dining table in order to economize space and simultaneously provide a uniquely designed, attractive, ergonomic, efficient, beneficial and desirable article of furniture. The present invention applies to said articles of furniture constructed of wood, plastic, metal, glass, rock, mineral or any other suitable material. The present invention also includes any colors, finishes, surface textures, laminates or the like that may be used.

It is an object of this invention to provide a freestanding combination corner hutch and table that once positioned in the corner of a room will not be required to be supportably attached to an adjacent wall. However, supportably attaching said hutch and table as described is optional and is included within the spirit of the scope of this invention.

Another object of this invention includes said article of corner furniture being fabricated in different sizes and located in any room in the home or workplace.

Another object of the present invention is to provide a plurality of hutch shelving that is permanently attached at predetermined heights and/or can be adjustably lowered or raised in height as desired.

Consumers will find this unique economical article of furniture to be quite novel in its daily use as well as its design and arrangement. Clearly this invention is a significant improvement and an advantage over the prior art.

DETAILED DESCRIPTION OF THE INVENTION

Figure 1:
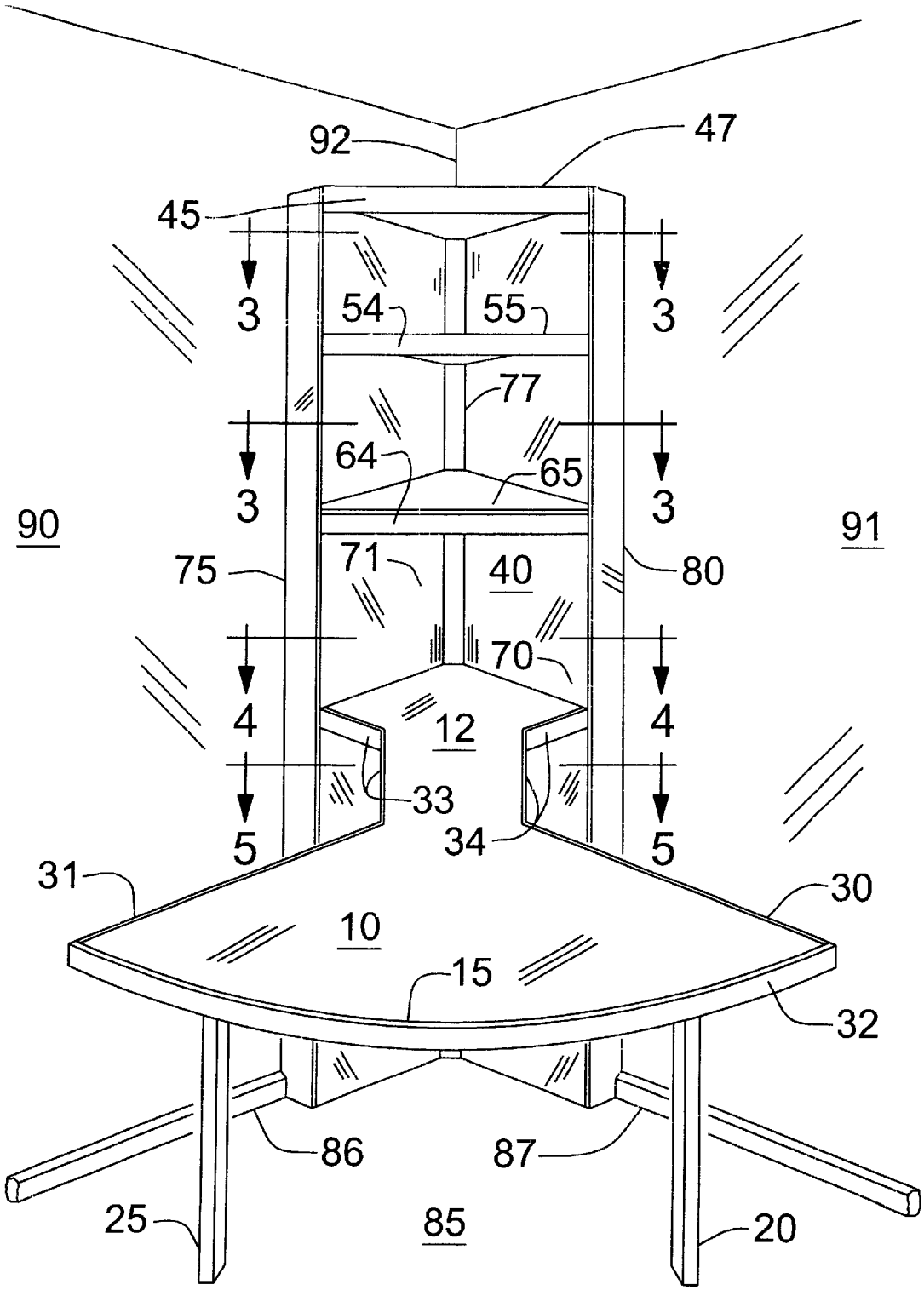
FIG. 1 is a perspective view of the present invention that is constructed of wood and positioned in the corner of a room.

FIG. 1 shows the present invention constructed of wood and positioned in a corner 92 of a typical room standing upright and comprised of a horizontal planar surface component, generally referenced as table 10, and a shelved hutch component generally referenced as hutch 40. Table 10 and hutch 40 are in communication with each other by way of a horizontal table extension 12 and are structurally integrated to form one combined and unitary article of corner furniture. Hutch 40 and table 10 with its vertical supporting leg members 20 and 25 are supportably located atop typical supporting floor 85. Optionally table 10 can be designed with additional supporting leg members or with a single pedestal means. Hutch 40 is freestanding and is not supportably attached to walls 90 or 91. Optionally hutch 40 can be attached to walls 90 and/or 91 if desirable. Hutch 40 is comprised of a horizontal top end portion 47, which can serve as a shelf, horizontal shelves 55 and 65, and table extension 12 which can function as a shelve as well. Proximal table end 15 of table 10 is configured as a 90-degree "pie" segment. As for an example of decor the present invention reflects table 10, table end 15, table extension 12, hutch 40, top end portion 47, and shelves 55 and 65 all finished in ¼" thick trims 30, 31, 32, 33, 34, 75, 77, 80, 45, 54 and 64. The visible walls of hutch 40 are finished using typical paneling 70 and 71. Existing wall baseboards 86 and 87 are modified in order for corner 92 to receive hutch 40.

Figure 2:
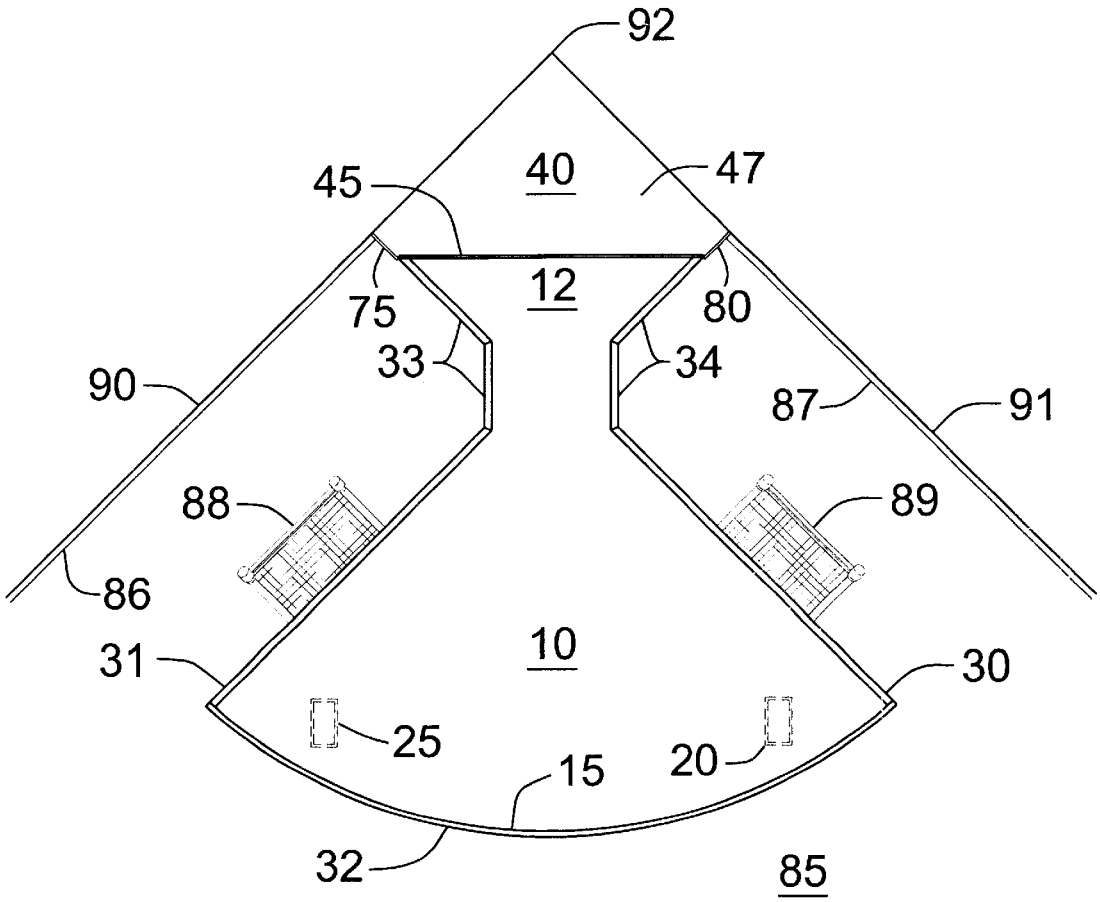
FIG. 2 is an overhead plan view of the present invention positioned in the corner of a room and reflecting a typical seating arrangement.

FIG. 2 is a plan view of the present invention reflecting a typical seating arrangement indicated by the locations of typical chairs 88 and 89. Chairs 88 and 89 are not included as part of the present invention but are shown for information only. Obviously more chairs could be used or bench type seating could be used as well. Leg members 20 and 25 are attached to the underside of table 10 and suitably located to avoid interference with occupant seating.

Figure 3:
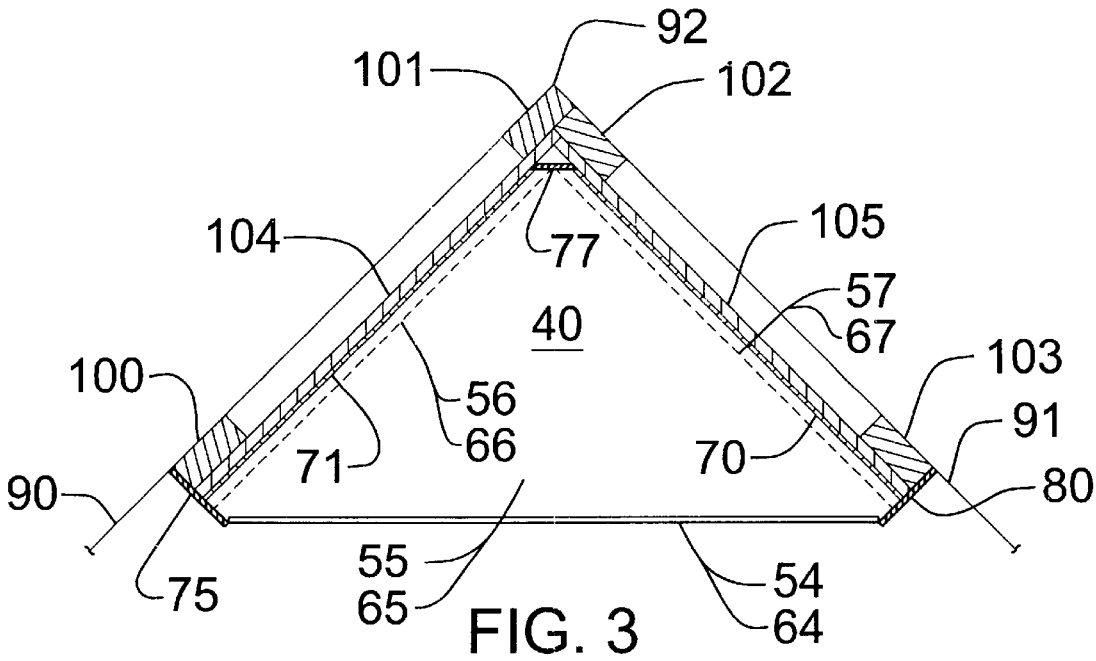
FIG. 3 is an upper sectional view of the present invention reflecting its vertical skeleton framework, trim finish and horizontal shelving.
Figure 4:
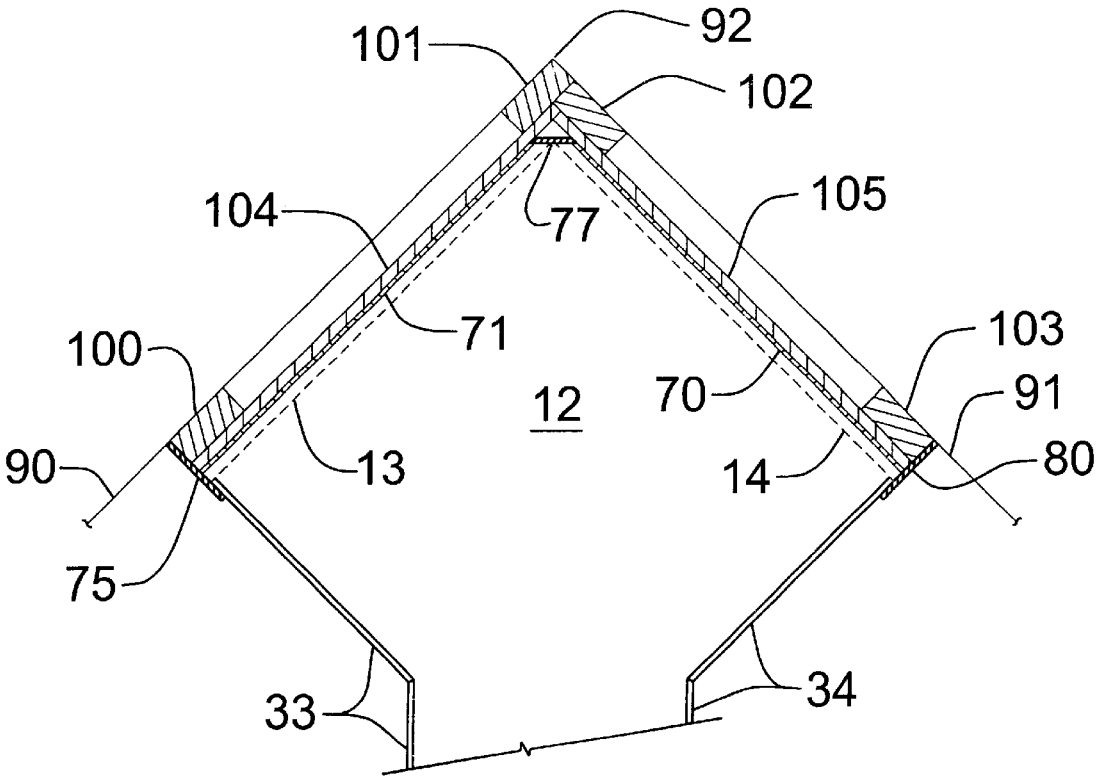
FIG. 4 is a mid sectional view of the present invention reflecting its vertical skeleton framework, trim finish and a horizontal portion of the table component.
Figure 5:
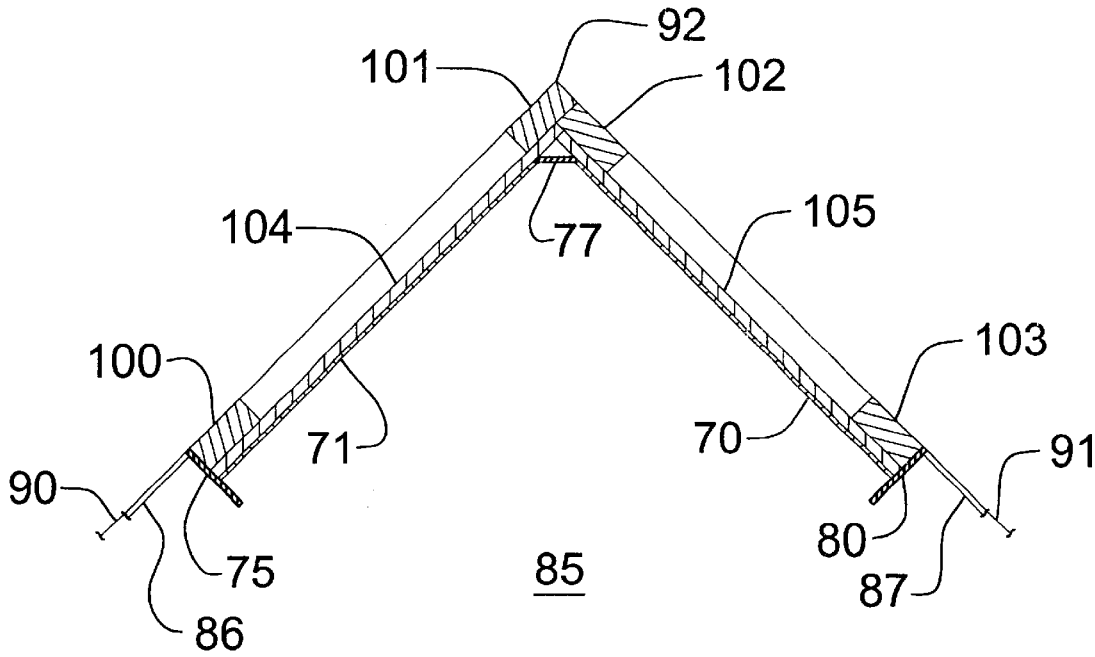
FIG. 5 is a lower sectional view of the hutch component of the present invention as it rests upon a supporting floor.

FIGS. 3, 4 and 5 reflect a typical freestanding vertical skeleton framework means for supporting hutch 40 and table extension 12. Said skeleton framework also serves as an attachment means for securing shelving, shelf cleating, finish trims and paneling.

The skeleton framework depicted in FIGS. 3, 4 and 5 is shown comprised of economical standard lumber such as 2×4 vertical members 100, 101, 102, and 103. Attached to said 2×4 vertical members are economical plywood sheet members 104 and 105.

FIG. 3 shows upper shelf 55, shelf support cleats 56 and 57, lower shelf 65, and shelf support cleats 66 and 67 attached to said framework.

FIG. 4 shows table extension 12 and table extension support cleats 13 and 14 attached to said framework.

FIG. 5 shows the remaining bottom portion of said hutch and framework resting on a typical supporting floor 85. Sections of existing wall baseboards 86 and 87 are usually cut and removed in order to accommodate placement of said hutch into corner 92. As an option lower sections of vertical members 100, 101, 102, and 103 can be pre-notched (not shown) in order to avoid modifying any existing wall baseboard.

The present invention as constructed of wood is assembled using standard construction and design practices, economical fastening means and installation procedures.

I claim:

1. A freestanding stationary combination article of dining furniture comprised of a single vertical shelved hutch structure and a dining table both structurally and physically symmetrically configured to be received in a corner defined by two converging walls, with said hutch structure in permanent communication with a fixed and outwardly extending seven-sided occupant accessible edged horizontal planar surface that shall serve specifically as a dining surface, whereby said shelved hutch structure is comprised of a plurality of triangular shaped corner shelving panels located above said dining surface and whereby the lower portion of said hutch structure below said dining surface functions only as a supporting leg member means, and whereby a single geometrically arrow-shaped proximal end portion of said horizontal planar surface originates at a permanent corner attachment location to said hutch structure and outwardly extends forming a mid narrow neck portion with two parallel sides that oppositely project away from said neck portion so that each said parallel side accordingly becomes parallel to a relevant corresponding said converging wall, whereby said parallel sides oppositely linearly terminate and connectively form a single ninety degree radius distal table end portion, whereby said distal table end portion is supported from below said dining surface by a single or plurality of leg member means located and positioned as to afford seating and leg room for occupants sitting in chairs, benches or a combination thereof about the seven-sided edged perimeter of said table.

* * * * *